US007934785B2

(12) United States Patent
Lang

(10) Patent No.: US 7,934,785 B2
(45) Date of Patent: May 3, 2011

(54) SELECTABLE GLOSS COATING SYSTEM

(75) Inventor: Joseph Herman Lang, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 441 days.

(21) Appl. No.: 12/050,726

(22) Filed: Mar. 18, 2008

(65) Prior Publication Data

US 2009/0237425 A1 Sep. 24, 2009

(51) Int. Cl.
*B41J 2/17* (2006.01)
*B41J 2/195* (2006.01)
*B41J 2/145* (2006.01)

(52) U.S. Cl. ..... 347/7; 347/40; 347/98

(58) Field of Classification Search ..... None
See application file for complete search history.

(56) References Cited

U.S. PATENT DOCUMENTS

| | | | | |
|---|---|---|---|---|
| 4,357,900 | A | 11/1982 | Buschor | |
| 5,196,236 | A | 3/1993 | Howard et al. | |
| 5,635,969 | A | 6/1997 | Allen | |
| 5,847,738 | A | 12/1998 | Tutt et al. | |
| 6,059,404 | A * | 5/2000 | Jaeger et al. | 347/88 |
| 6,102,537 | A | 8/2000 | Kato et al. | |
| 6,106,623 | A | 8/2000 | Nishikawa | |
| 6,170,881 | B1 | 1/2001 | Salmon et al. | |
| 6,249,355 | B1 | 6/2001 | Trask | |
| 6,369,844 | B1 | 4/2002 | Neumann et al. | |
| 6,681,095 | B1 | 1/2004 | Tsuda | |
| 6,877,850 | B2 | 4/2005 | Ishimoto et al. | |
| 6,925,281 | B2 | 8/2005 | Weber et al. | |
| 6,939,002 | B2 | 9/2005 | Janosky et al. | |
| 6,993,272 | B2 | 1/2006 | Lange et al. | |
| 7,152,950 | B2 | 12/2006 | Takekoshi et al. | |
| 7,178,898 | B2 | 2/2007 | Hoshino | |
| 7,180,635 | B2 | 2/2007 | Wang et al. | |
| 7,184,177 | B2 | 2/2007 | Trelewicz et al. | |
| 7,196,714 | B2 | 3/2007 | Someno | |
| 7,275,804 | B2 | 10/2007 | Matsushima | |
| 7,301,675 | B2 | 11/2007 | Wang et al. | |

(Continued)

FOREIGN PATENT DOCUMENTS

| | | |
|---|---|---|
| EP | 1223046 | 7/2002 |

(Continued)

OTHER PUBLICATIONS

English Language Abstract of JP 355156 A, Dec. 1992.*

(Continued)

*Primary Examiner* — Stephen D Meier
*Assistant Examiner* — Alexander C Witkowski
(74) *Attorney, Agent, or Firm* — Maginot, Moore & Beck LLP

(57) ABSTRACT

A coating system comprises a high gloss coating ink supply source, and a low gloss coating ink supply source. The system includes a coating module configured to receive the high gloss coating ink and the low gloss coating ink. The coating module includes a first group of nozzles configured to emit the high gloss coating ink, and a second group of nozzles configured to emit the low gloss coating ink. The coating module includes a mixing reservoir configured to receive the high gloss coating ink and the low gloss coating ink and to commingle the high gloss coating ink and the low gloss coating ink to form an intermediate gloss coating ink. The coating module includes a third group of inkjet nozzles configured to emit the intermediate gloss coating ink.

21 Claims, 2 Drawing Sheets

U.S. PATENT DOCUMENTS

| | | | | |
|---|---|---|---|---|
| 7,304,770 | B2 | 12/2007 | Wang et al. | |
| 7,305,200 | B2 | 12/2007 | Hoffman et al. | |
| 7,324,241 | B2 | 1/2008 | Eschbach et al. | |
| 7,338,143 | B2 | 3/2008 | Onishi et al. | |
| 7,382,495 | B2 | 6/2008 | Liu et al. | |
| 7,495,798 | B2 | 2/2009 | Kakutani | |
| 7,508,544 | B2 | 3/2009 | Kakutani | |
| 7,510,277 | B2 | 3/2009 | Konno et al. | |
| 7,511,855 | B2 | 3/2009 | Butterfield et al. | |
| 7,533,982 | B2 | 5/2009 | Yoneyama | |
| 7,578,587 | B2 | 8/2009 | Belelie et al. | |
| 2003/0142343 | A1 | 7/2003 | Bezenek | |
| 2005/0179725 | A1 | 8/2005 | Matsushima | |
| 2006/0284929 | A1 * | 12/2006 | Matsuzawa et al. | 347/43 |
| 2008/0079971 | A1 | 4/2008 | Liu et al. | |
| 2008/0248196 | A1 | 10/2008 | Anderson et al. | |
| 2009/0237425 | A1 | 9/2009 | Lang | |
| 2009/0263172 | A1 | 10/2009 | Kovacs | |

FOREIGN PATENT DOCUMENTS

JP 04355156 A * 12/1992

OTHER PUBLICATIONS

EP Search Report corresponding to European Patent Application 09155428, European Patent Office, Munich Germany, May 10, 2010 (6 pages).

* cited by examiner

SELECTABLE GLOSS COATING SYSTEM

TECHNICAL FIELD

This disclosure relates generally to inkjet printers, and, in particular, to inkjet printers that use coating inks.

BACKGROUND

In general, inkjet printing machines or printers include at least one printhead unit that ejects drops or jets of liquid ink onto an image receiving surface such as an image substrate. A phase change inkjet printer employs phase change inks that are in the solid phase at ambient temperature, but transition to a liquid phase at an elevated temperature. The melted ink can then be ejected as drops or jets by a printhead assembly onto an image substrate at the elevated operating temperature of the machine or printer. The image receiving surface may be a recording media in which case the ink can be ejected directly onto the image substrate, or, alternatively, an intermediate transfer surface in which case the ink is ejected onto the intermediate transfer surface and subsequently transferred to a recording media.

One issue faced in inkjet printing technology is controlling the gloss level of all or parts of an image, page, or print job. Gloss is a measure of the reflective properties of a surface. High gloss indicates that the surface reflections are mirror-like or specular, where the angle of reflection closely matches the angle of incidence of light illuminating the surface. Low gloss indicates that the surface produces diffuse reflections where incident light is scattered over a broad range of angles during reflection. Gloss levels may be influences by both the type of colorant as well as type of media used to form the printed image. Controlling gloss levels of a printed image may be difficult because printed ink may cause a change in gloss relative to the unprinted media. In addition, variations in the density of the ink deposited on the media to form an image may cause corresponding variations in the gloss level of the printed image. Thus, when an image is printed using many colors, the colors may vary widely in their levels of gloss, and there may be noticeable differences between the gloss levels of printed areas as opposed to non-printed areas of image. These variations in gloss levels across a printed image may not be acceptable to consumers.

One method that has been used to control gloss levels of printed images is to coat the entire printed media with a colorless coating material that is designed to provide a protective layer on the printed media as well as to provide a substantially uniform gloss to the printed media. There are many types of coating materials that may be used. For example, coating inks have been developed that are capable of being jetted using standard printheads. The composition of coating inks can be adjusted to provide substantially any level of gloss to a printed image such as high gloss, matte, satin, etc.

In some cases, consumers may desire to be able to select and print specific gloss levels to all or part of a printed image, page or print job. The various gloss levels, e.g., high gloss, semi-gloss, matte, etc., may each have characteristics that are desired for various printing applications. For example, color images having a high gloss level may have more vibrant colors than color images having a lower gloss level. Similarly, printed text having a low gloss level may be easier to read than printed text having a high gloss level. By selectively varying the gloss level across the printed media, different areas of the printed media may be enhanced and/or contrasted to produce aesthetically striking results.

Most previously known printers, however, are capable of providing only a single gloss finish to printed images, e.g., a high gloss finish. Some printers have been developed that are capable of providing multiple gloss finishes to printed images. In order to provide the multiple gloss levels in these systems, however, a separate coating ink is typically provided for each desired gloss level. Because coating inks having different gloss levels are typically manufactured at an off-site location, supplies of each desired gloss coating ink may have to be ordered well in advance of their actual use. In addition, customers may be required to order large quantities of the different gloss inks from the supplier, which may be more than they require or cost more money than they desire to spend.

SUMMARY

A coating system for use in an inkjet imaging device has been developed that is capable of mixing at least one intermediate gloss coating ink in a printer from a preloaded high gloss coating ink and a low gloss coating ink. The coating system comprise a high gloss coating ink supply source for supplying a high gloss coating ink having a first gloss level; and a low gloss coating ink supply source for supplying a low gloss coating ink having a second gloss level, the second gloss level being less than the first gloss level. The coating system includes a coating module configured to receive the high gloss coating ink and the low gloss coating ink from the high gloss coating ink supply source and the low gloss coating ink supply source, respectively. The coating module includes a first group of inkjet nozzles configured to emit the high gloss coating ink; and a second group of inkjet nozzles configured to emit the low gloss coating ink. The coating module also includes a mixing reservoir configured to receive quantities of the high gloss coating ink and the low gloss coating ink and to commingle a quantity of the high gloss coating ink and a quantity of the low gloss coating ink so that an intermediate gloss coating ink results. The intermediate gloss coating ink has a gloss level between the first gloss level and the second gloss level. A third group of inkjet nozzles is operably connected to the mixing reservoir to receive the intermediate gloss coating ink from the mixing reservoir and to emit the intermediate gloss coating ink.

In another embodiment, an ink jet imaging device is provided. The inkjet imaging device includes an image receiving surface; a plurality of colored ink supply sources, each colored ink supply source being configured to supply a different color of ink; and a printhead operably connected to at least one colored ink supply sources, the printhead being positioned to emit the colored ink received from the at least one colored ink supply source onto the image receiving surface. The imaging device also includes a high gloss coating ink supply source for supplying a high gloss coating ink having a first gloss level, and a low gloss coating ink supply source for supplying a low gloss coating ink having a second gloss level. A coating module is configured to receive the high gloss coating ink and the low gloss coating ink from the a high gloss coating ink supply source and the low gloss coating ink supply source, respectively. The coating module includes a first group of inkjet nozzles configured to emit the high gloss coating ink onto the image receiving surface; and a second group of inkjet nozzles configured to emit the low gloss coating ink onto the image receiving surface. The coating module includes a mixing reservoir configured to receive quantities of the high gloss coating ink and the low gloss ink and to commingle a quantity of the high gloss coating ink and a quantity of the low gloss coating ink so that a intermediate gloss coating ink results. A third group of inkjet nozzles is operably connected to the mixing reservoir to receive the intermediate gloss coating ink from the mixing reservoir and to emit the intermediate gloss coating ink onto the image receiving surface.

In yet another embodiment, a method of operating an inkjet imaging device is provided. The method comprises supplying a high gloss coating ink having a first gloss level to a first group of inkjet nozzles and to a mixing reservoir; supplying a low gloss coating ink having a second gloss level to a second group of inkjet nozzles and to the mixing reservoir, the second gloss level being less than the first gloss level; commingling the high gloss coating ink and the low gloss coating ink in the mixing reservoir so that a intermediate gloss coating ink results, the intermediate gloss coating ink having a gloss level between the first gloss level and the second gloss level; supplying the intermediate gloss coating ink to a third group of inkjet nozzles; and selectively emitting at least one of the high gloss coating ink, the low gloss coating ink, and the intermediate gloss coating ink from the first, second and third groups of inkjet nozzles, respectively.

BRIEF DESCRIPTION OF THE DRAWINGS

The foregoing aspects and other features of the radiant heating unit and web heating systems incorporating radiant heating units are explained in the following description, taken in connection with the accompanying drawings, wherein.

DETAILED DESCRIPTION

Figure 1:
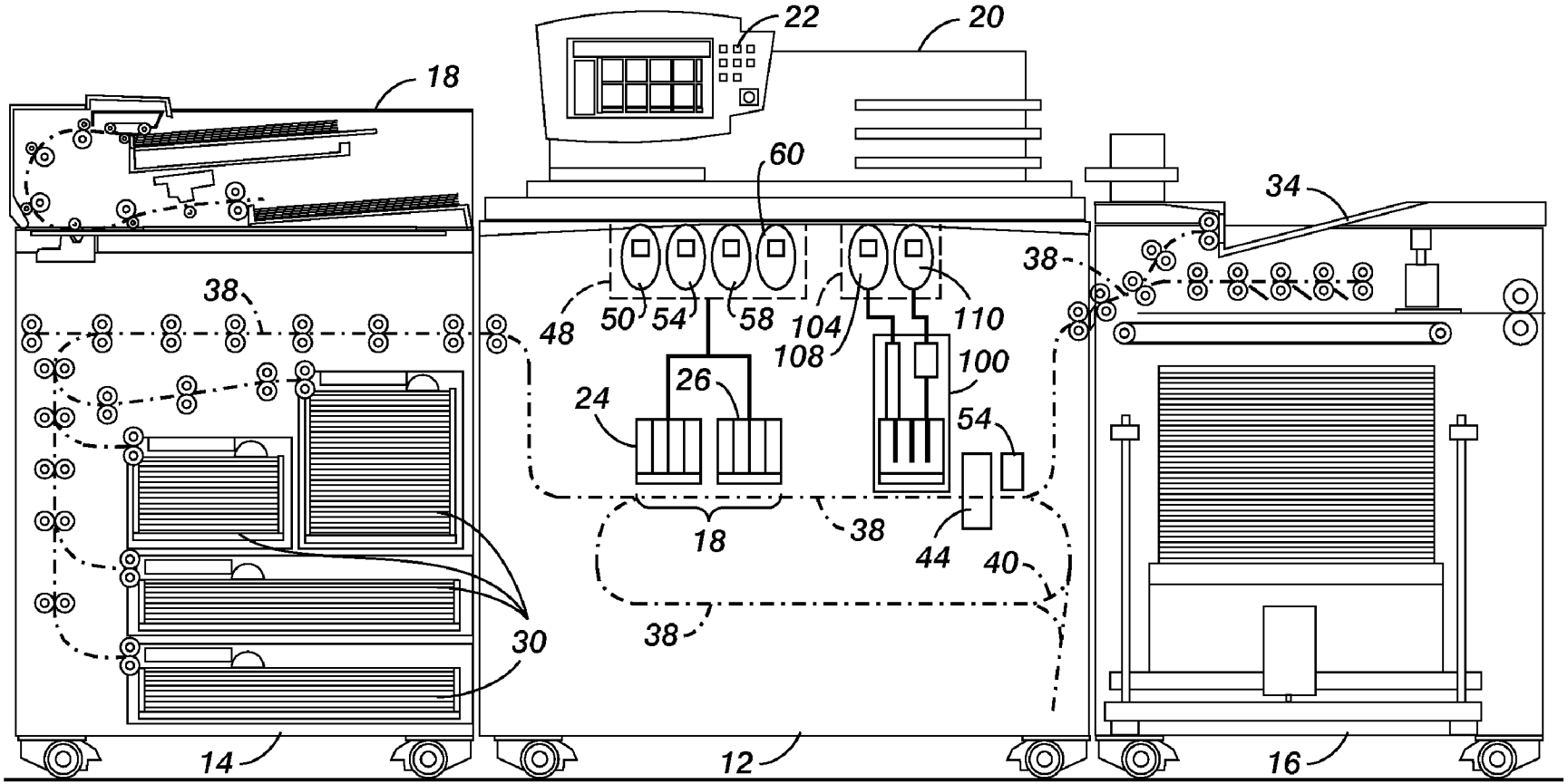
FIG. 1 is a block diagram of a phase change imaging device that includes a coating system.

For a general understanding of the present embodiments, reference is made to the drawings. In the drawings, like reference numerals have been used throughout to designate like elements.

As used herein, the term "imaging device" generally refers to a device for applying an image to print media. "Print media" or "recording media" can be a physical sheet of paper, plastic, or other suitable physical print media substrate for images, whether precut or web fed. The imaging device may include a variety of other components, such as finishers, paper feeders, and the like, and may be embodied as a copier, printer, or a multifunction machine. A "print job" or "document" is normally a set of related sheets, usually one or more collated copy sets copied from a set of original print job sheets or electronic document page images, from a particular user, or otherwise related. An image generally may include information in electronic form which is to be rendered on the print media by the marking engine and may include text, graphics, pictures, and the like.

As used herein, the terms "gloss" generally refers to the capacity of a surface to reflect more light in the specular direction as compared to other directions. Gloss level is a measurement of the degree of specular reflectance of a surface. Gloss levels are referred to with reference to gloss units as measured by a conventional gloss meter, such as a Gardner gloss meter, that measures the gloss level at a specific angle of incidence with respect to the surface, e.g., 20 degree, 30 degree, 45 degree, 60 degree, 75 degree and 80 degree, etc.

With reference to FIG. 1, there is shown an embodiment of a phase change inkjet imaging device 10 that is capable of providing multiple selectable gloss coatings to printed images. In particular, the exemplary imaging device includes a print station 12 that includes at least one printhead module 24, 26 for emitting ink onto print media to form images. The print station 12 also includes a coating system 100 for providing a customer selectable coating to printed media. As explained in more detail below, the coating system 100 includes a high gloss ink and a low gloss ink for providing a high gloss coating and a low gloss coating, respectively. The coating system 100 is configured to mix the high and low gloss coating inks in the printer to form at least one intermediate gloss coating for use on the printed media.

The print station 12 is interposed between a feeder module 14 and a finishing module 16. The print station 12 is fed with print media from the feeder module 14 as is known in the art. For example, the feeder module 14 may include a plurality of print media sources such as trays 30. Each feeder tray 30, may include print media having different attributes such as roughness, coats, weights and the like. The print media may be substantially any type of media upon which the printhead modules may print, such as: high quality bond paper, lower quality "copy" paper, overhead transparency sheets, high gloss paper, etc. In alternative embodiments, the printer 10 may be a web fed printer in which the feeder module 14 is configured to feed a continuous web of material, such as a roll of paper, a supply roller, or the like, (not shown) to the print station which may then be taken up on a take up roller or post-processed by, for example, cutting or trimming as needed at the finishing module.

The finisher module 16 receives the print media from the print station 12. The term "finisher" or "finishing module" as broadly used herein in connection with the exemplary embodiment or embodiments disclosed herein, is any post-printing accessory device such as an inverter, reverter, sorter, mailbox, inserter, interposer, folder, stapler, collator, stitcher, binder, over-printer, envelope stuffer, postage machine, output tray, or the like. In the illustrated embodiment, the finisher module 16 includes an output tray 34 to which received print media sheets can be delivered. The finisher module 16 may be configured to provide various finishes to the print media sheets of a print job or jobs, or even a portion of a print job. Possible finishes that may be performed by the finisher can include, for example, patterns of collation, binding or stapling available by the finisher module. Additional, advanced finishes can include, for example, other binding techniques, shrink wrapping, various folding formats, etc. The finisher module 16 can also be provided with multiple output trays (not shown) and the ability to deliver specified print media sheets to a selected output tray or trays.

A print media transporting system links the feeder module 14, print station 12, and finisher module 16. The print media transporting system includes a network of media pathways 38 for guiding the movement of the print media through the imaging device 10. The print media transporting system may comprise drive members, such as pairs of rollers, spherical nips, airjets, or the like. The transport system may further include associated motors for the drive members, belts, guide rods, frames, etc. (not shown), which, in combination with the drive members, serve to convey the print media along selected pathways at selected speeds. In the illustrated embodiment, the print media from the source 14 is delivered to the print station 12 by a pathway which is common to the trays 30. The print media is printed on by the printhead modules of the print station 12 that are arranged along the media pathway 38. The pathway 38 also conveys the printed media to the finisher 38.

The print station 12 may also include a fixing assembly 44 for fixing the emitted ink drops, or image, to the web. The fixing assembly 44 may be any suitable type of device or apparatus, as is known in the art, which is capable of fixing the image to the media. The type of fixing assembly is dependent upon the type(s) of ink that are used in the imaging device. For example, in solid ink embodiments, the fixing assembly may comprise a pair fixing rollers (not shown) that are positioned in relation to each other to form a nip through which the media is fed. The ink drops on the media are pressed into the media and spread out on the media by the pressure formed by the nip. For aqueous inks, the fixing assembly may include a dryer or heater for applying heat to the printed ink in order to fix the ink to the media. In embodiments in which UV curable inks are used, the fixing assembly may include a UV lamp for applying ultraviolet radiation to the printed ink.

Operation and control of the various subsystems, components and functions of the device 10 are performed with the aid of a controller 20. The controller 20 may be implemented as hardware, software, firmware or any combination thereof. In one embodiment, the controller 20 comprises a self-contained, microcomputer having a central processor unit (not shown) and electronic storage (not shown). The electronic storage may store data necessary for the controller such as, for example, the image data, component control protocols, etc. The electronic storage may be a non-volatile memory such as a read only memory (ROM) or a programmable non-volatile memory such as an EEPROM or flash memory. Of course, the electronic storage may be incorporated into the inkjet printer, or may be externally located.

During operations, the controller 20 receives image data from an image data source. The image data source may be any one of a number of different sources, such as a scanner, a digital copier, a facsimile device that is suitable for generating electronic image data, or a device suitable for storing and/or transmitting electronic image data, such as a client or server of a network, or the Internet. To print multicolor images, the controller 20 may use a color conversion process to convert the color specifications in the image data to the color space that is capable of being printed by the imaging device 10. In order to print multicolor images that include shades of color other than the colors of ink as supplied from the ink supply source, the controller may be configured to implement a halftone imaging process as is known in the art to produce the desired color based on the input color value. For example, the controller may be configured to convert a color space of the image to be rendered into halftone densities of a plurality of colorants available within the imaging device.

With continued reference to FIG. 1, the print station 12 includes multiple printhead modules 24, 26 for emitting ink onto the print media in accordance with the image data. In the embodiment of FIG. 1, print station is configured to implement a solid ink printing process to print images onto the print media. Accordingly, the printhead modules of the print station are configured as phase change ink, or solid ink, printhead modules. Each printhead module is appropriately supported adjacent the media pathway for emitting drops of ink directly onto the print media as the media moves through the print zone 18. In alternative embodiments, the printhead assembly may be configured to emit drops onto an intermediate transfer member (not shown), such as a drum or belt, for subsequent transfer to the media.

Ink is supplied to the printhead modules from the solid ink supply 48. Since the phase change ink imaging device 10 is a multicolor device, the ink supply 48 includes a plurality of solid ink sources 50, 54, 58, 60 which are each configured to supply a different color of ink to the printhead modules 24, 26. In one embodiment, each solid ink source 50, 54, 58, 60 of the solid ink supply comprises a dedicated channel for loading, feeding, and melting solid ink sticks of a particular color. In particular, the respective ink channels 50, 54, 58, 60 guide the appropriate colored solid ink sticks to a melting and control assembly or apparatus (not shown) for melting or phase changing the solid form of the phase change ink into a liquid form, and then supplying the liquid phase change ink to the printhead modules.

The solid ink sticks utilized in the imaging device may be standard colors (e.g., cyan, magenta, yellow, or black). For example, in the embodiment of FIG. 1, the solid ink supply 48 includes four sources representing the four CMYK colors (cyan, yellow, magenta, black) of solid ink. The system, however, may be adapted for a higher or lower number of different colored solid inks. For example, the imaging device may be configured with an expanded color gamut that includes solid inks of other colors in addition to the CMYK colors. In this embodiment, the solid ink supply includes solid ink sources (not shown) for supplying light cyan, light magenta, orange and green (cmOG) although any color may be used. In addition, although not depicted in FIG. 1, the imaging device may include solid ink sources for supplying premixed custom color ink which may be substantially any color. Any suitable number of solid ink sources and/or combinations of different colors of ink (e.g., standard CMYK, expanded gamut cmOG, or premixed colors) may be utilized in the imaging device 10. The total number of different colors and combination of colors of solid ink made available in the system 10 may be dependent upon the overall number and range of colors desired to be printed.

Each printhead module 24, 26 is configured to receive at least one of the colors of ink from the solid ink supply and to emit the ink onto the media. Accordingly, each printhead module 24, 26 includes at least one printhead having a plurality of inkjet nozzles for ejecting the ink received from the solid ink supply. In one embodiment, each printhead 24, 26, is configured to eject ink by displacing ink in an ink pressure chamber thereby ejecting ink droplets. As is known in the art, a drive mechanism, such as a piezoelectric transducer bonded to a thin diaphragm, may be used to displace the ink in the pressure chamber. The controller 20 is configured to generate driving signals for driving the inkjets of the printhead modules to expel ink from the inkjets in the printheads to form an image on the print media in accordance with the image data.

In the embodiment of FIG. 1, there is depicted a CMYK printhead module 24 and an expanded gamut (cmOG) printhead module 26. The CMYK printhead module, as is known in the art, includes a printhead for each of the CMYK colors, i.e., a printhead for emitting cyan ink, a printhead for emitting magenta ink, a printhead for emitting yellow ink and a printhead for emitting black ink. Similarly, the expanded gamut printhead module includes a printhead for each of the colors in the expanded color gamut (cmOG), i.e., a printhead for emitting light cyan ink, a printhead for emitting light magenta ink, a printhead for emitting orange ink and a printhead for emitting green ink. Although, the CMYK printhead module and cmOG printhead module have been described as having a separate printhead for each color of ink, other arrangements are contemplated. For example, each printhead module may comprise a single printhead having a dedicated array of inkjet nozzles for ejecting each color of ink received from the solid ink supply, i.e., an array of nozzles for ejecting cyan ink, an array of nozzles for ejecting magenta ink, etc. Alternatively, there may be a separate printhead module for each color of ink utilized in the imaging device. For example, there may be a cyan printhead module, a magenta printhead module, a yellow printhead module, etc.

The printheads utilized in the printhead modules may have any suitable configuration such as page-width array, partial page-width array, and carriage type printheads. For example, a printhead module may have at least one page-width array printhead for each color of ink associated with the printhead module. In another embodiment, a printhead module may have a plurality of partial-width array printheads for each color associated with the printhead with the plurality of partial-width array printheads being arranged end-to-end in a straight line or staggered formation for spanning the media pathway of the imaging device. In yet another embodiment, the printhead modules may be mounted on a carriage or similar support structure so that the printheads of the printhead module may be moved with respect to the media. As can be determined by one of ordinary skill in the art, a plurality of possible arrangements and configurations for the printheads of the printhead modules are possible and are contemplated within the scope of this disclosure.

The inkjet imaging device of FIG. 1 includes a coating system 100. The coating system has a coating ink supply source 104 that is configured to supply at least two colorless coating inks, each coating ink being configured to provide a different gloss level to a printed image. In the embodiment of FIG. 1, the coating ink supply source 104 is configured to supply a high gloss coating ink 108 and a low gloss coating ink 110. The high gloss coating ink is for providing a glossy finish to all or parts of a printed image, page, job, etc. The low gloss coating ink is for providing a low gloss, or matte, finish to all or parts of a printed image, page, job, etc. The high and low gloss levels may be any suitable level. For example, in one embodiment, the high gloss level may be greater than approximately 60 gloss units while the low gloss level may be less than approximately 20 gloss units.

The high and low gloss coating inks may have any suitable composition that is capable of producing the desired gloss level. In application, although not necessary, the coating inks may be printed with the same type of printheads that are used for the colored ink. In one embodiment, the coating inks comprise a curable ink, such as UV curable inks or Hybrid UV curable inks. Any suitable type of ink, however, may be used including solid inks, aqueous inks, solvent based inks, etc. The high and low gloss coating inks may each have substantially the same composition except that the low gloss coating ink may include flatting or dulling agents, as are known in the art, to reduce the gloss level of the low gloss coating ink. Flatting agents, such as silica, barytes, diatomaceous earth and heavy metal soaps, are finely divided particulate materials of irregular shape which tend to dull the surface appearance of the cured coating by dispersing incident light rays.

The coating system 100 is configured to mix an intermediate gloss coating ink in the printer from the high gloss and low gloss coating inks that are preloaded into the imaging device. Accordingly, the high gloss coating ink and the low gloss coating ink are mixable to produce an intermediate gloss coating that has a gloss level corresponding to the relative percentages of the high and low gloss coating inks in the mixture. The term "Intermediate gloss," as used herein, may generally refer to any gloss level that is between the high gloss level and the low gloss level provided by the high gloss coating ink and the low gloss coating ink, respectively. For example, in one embodiment, the intermediate gloss level may be any value between approximately 10 and 90 gloss units.

Figure 2:
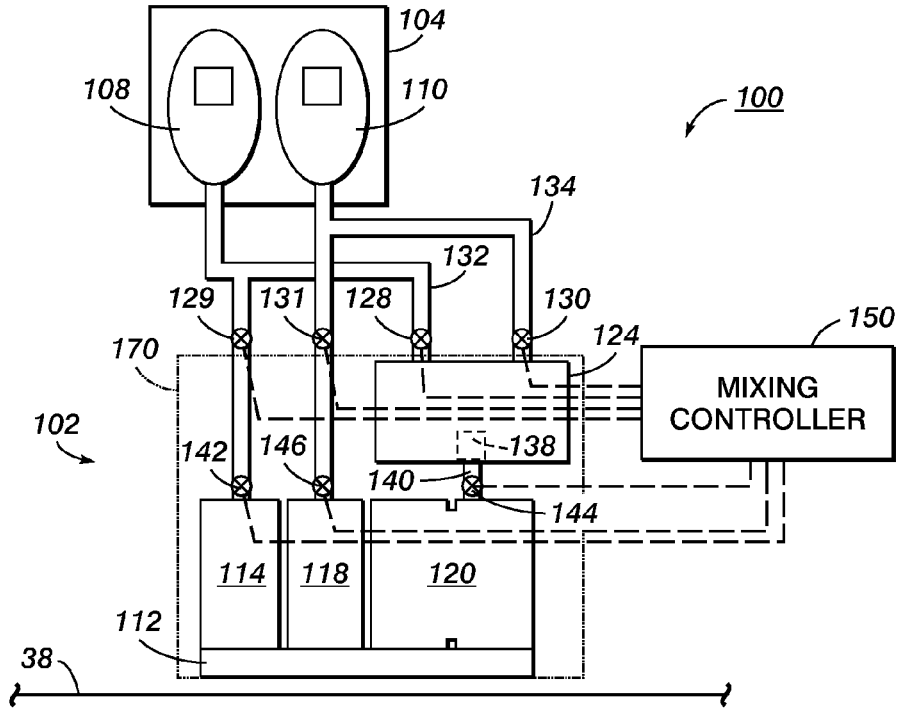
FIG. 2 is a block diagram of one embodiment of the coating system of FIG. 1.

Referring now to FIG. 2, a schematic diagram of an exemplary coating system is shown arranged adjacent the media pathway 38 of an imaging device. The coating system includes a coating module 102 with a printhead 112 having an array of inkjet nozzles 114 for emitting the high gloss ink, an array of inkjet nozzles 118 for emitting the low gloss ink, a mixing reservoir 124 for mixing measured quantities of the high gloss ink and low gloss ink to form an intermediate gloss ink, and an array of inkjet nozzles 120 for emitting the intermediate gloss ink.

The mixing reservoir 124 is configured to receive the high gloss coating ink and the low gloss coating ink from the respective supply sources 108, 110 and to mix the different coating inks to form an intermediate gloss coating ink. Accordingly, the mixing reservoir includes a pair of coating ink supply inlets 132, 134 that are configured to receive the coating ink from the ink sources. The coating system 100 includes dispensers for controlling the flow of the coating inks the mixing reservoir via the ink supply inlets. Accordingly, the custom color printhead module of FIG. 2 includes dispensers 128, 130 for controlling the flow of ink into the mixing reservoir from each of the high gloss ink source and the low gloss ink source. In addition, the coating module may include dispensers 129, 131 for controlling the flow of the ink from the gloss ink sources to the respective high and low gloss nozzles of the printhead. The flow rates of the inks through the dispensers may be determined in any suitable manner as is known in the art so that the quantities of the inks that are dispensed into the mixing reservoir may be accurately controlled. The dispensers 128, 129, 130, 131 may comprise one-way dispensing valves that open and close to control the flow of ink from an associated ink supply source to the mixing reservoir 124 or the respective high and low gloss inkjet arrays. The dispensers, however, may comprise any suitable device or structure that is capable of controlling and/or metering the ink from the respective ink supply sources. For example, the dispensers may include pumps, pressure sensors, temperature sensors, etc. for facilitating the accurate dispensing of the inks into the reservoir.

The mixing reservoir 124 may comprise any suitable container or structure capable of holding the coating inks received via the dispensers. The mixing reservoir may be any size. In the embodiment of FIG. 2, the mixing reservoir is configured to hold approximately 10 ml of ink. The relatively small size of the reservoir allows for faster mixing of the component gloss coating inks and minimizes the amount of the mixed gloss coating ink that has to be maintained in the reservoir ready for printing so that the ink is not wasted. The mixing reservoir 124 may include one or more mixing elements 138, which may be, for example, mechanical, magnetic, pneumatic, hydraulic, or ultrasonic stirrers, powered by electricity or other suitable source. The mixing element 138 is configured to commingle the different quantities of the high gloss and low gloss coating inks in the mixing reservoir to form an intermediate gloss coating ink.

The mixing reservoir 124 is connected to the printhead array 120 via a supply conduit 140. The intermediate gloss coating ink in the mixing reservoir 124 may be supplied to the printhead array 120 as needed for printing onto the print media. The system may include a dispenser 144 for enabling and disabling the flow of the coating ink into the printhead array 120 from the mixing reservoir 124. The printhead 112 of the coating system may be configured for removal from the housing 170. Accordingly, the dispenser 144 may be configured as a disconnect valve to allow the printhead to be easily removed from the mixing reservoir 124. In addition, the module may include disconnect valves 142, 146 for removably connecting the supply lines of the gloss inks to the high and low gloss inkjet arrays Together, the disconnect valves 142, 144, and 146 enable the removal of the printhead from the coating module for cleaning, replacement, maintenance, etc. The disconnect valves are advantageously configured to prevent the flow of ink from the mixing reservoir or ink sources when the printhead is removed from the module.

Figure 3:
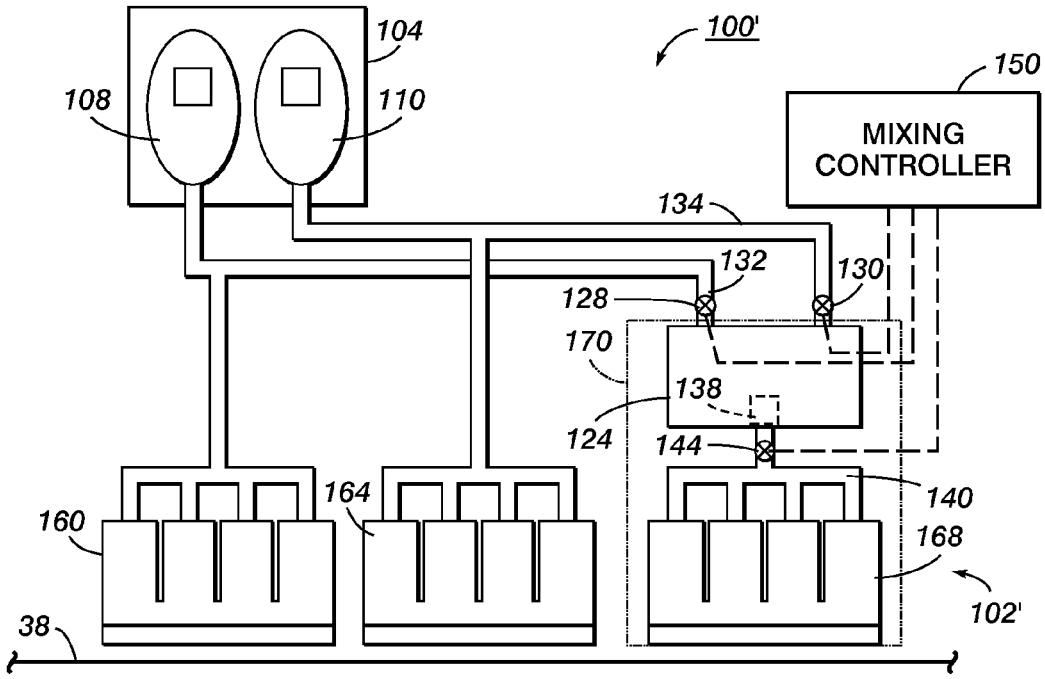
FIG. 3 is a block diagram of another embodiment of the coating system of FIG. 1.

Although the coating system has been described as having a printhead with different arrays of inkjet nozzles for emitting each of the different gloss levels of ink. The coating system may include a separate printhead for emitting each of the high, low and intermediate gloss coating inks. For example, FIG. 3 shows an alternative embodiment of the coating system 100' which includes a high gloss printhead 160, a low gloss printhead 164 and an intermediate gloss coating module 102' that includes a printhead 168. In this embodiment, the printhead 168 may be configured for removal or replacement from the coating module 102'. For example, the printhead used in the coating system may be similar or even identical to the printheads used in the standard printhead modules. Thus, the coating module 102' may comprise a "carrier" that accepts a standard ink jet printhead. To configure the printhead 168 for removal from the custom color module, the supply valve 144 may be configured as a disconnect valve to allow the printhead to be easily removed from the coating module. The disconnect valve is advantageously configured to prevent the flow of ink from the mixing reservoir through the custom color supply conduit when the printhead is removed from the module.

With reference to FIGS. 2 and 3, the coating system 100, 100' may include a mixing controller 150. The mixing controller 150 is configured to control the dispensers 128, 130 to dispense measured quantities of each component coating ink into the mixing reservoir to form a gloss coating ink having a target gloss level. In addition, the mixing controller 150 controls the mixing element 138 in the reservoir 124 to mix the component inks to form the target gloss ink. The relative percentages of each of the high gloss ink and the low gloss ink that are required to form a target intermediate gloss ink may be determined with reference to a gloss level identifier for the intermediate gloss coating ink. For example, the gloss level identifier may have associated mixing data that specifies the flow rates of each gloss coating ink, durations for opening the valves 128, 130 in order to dispense the appropriate concentrations of each component gloss ink into the mixing reservoir, duration of the mixing phase, etc. All of the possible gloss level identifiers and associated mixing data may be stored in memory in a data structure such as a database or table. The mixing controller 150 may use the gloss level identifier as a lookup key for accessing the data structure to retrieve the mixing data associated with the particular identifier. Once the mixing data is determined for a desired intermediate gloss level, the mixing controller 150 controls the dispensers 128, 130 in order to dispense measured quantities of the high gloss coating ink and the low gloss coating ink into the mixing reservoir according to mixing data and controls the mixing element to mix the component gloss inks to form the target intermediate gloss ink. Mixing data may be determined for each desired level of intermediate gloss in any suitable manner. For example, the mixing data may be determined empirically and subsequently stored in the memory of the imaging device for access by the controller 150.

The mixing reservoir 124 may also include a level sensor (not shown) for sensing a level of the intermediate gloss ink within the mixing reservoir 124. During printing, the controller 150 is configured to monitor the ink level in the mixing reservoir 124 to ensure that the mixing reservoir is constantly replenished by the component gloss inks in the ratios that are defined by the mixing data corresponding to the desired intermediate gloss ink. For example, as printing activities continue, the controller 150 monitors the level of the mixed ink in the mixing reservoir 124 via the level sensor and controls the appropriate dispensers 128, 130 to replenish the mixing reservoir 124 with the appropriate amounts of the component gloss inks as the ink is printed.

The mixing controller 150 is configured to maintain the intermediate gloss ink at a substantially consistent gloss level in the mixing reservoir as well as maintain a substantially constant level of ink within the reservoir. Over time, the output of the imaging device may drift (or deviate from predetermined optimum standards) due to various factors. These factors include environmental conditions (temperature, relative humidity, etc.), use patterns, the type of media (e.g., different paper types and paper batches, transparencies, etc.) used, variations in media, general wear, etc. Accordingly, the mixing controller may be configured to monitor the gloss levels printed by the coating system to detect deviations from a target gloss level. The gloss level of the coating inks printed by the coating system may be measured by positioning a glossmeter adjacent to the media pathway downstream from the coating system. For example, referring to FIG. 1, the imaging device 10 may include a glossmeter 154 positioned adjacent the media pathway downstream from the coating system 100 to measure the gloss level on the printed media. The measured gloss level may be compared to the target gloss level to detect deviations in the gloss level from the target gloss level. Based on the differences between the target gloss level and the actual printed gloss level, the mixing controller 150 may adjust the mixing data and save the adjustments so that the adjusted mixing data may be utilized the next time the particular gloss level is desired.

The coating system may be configured to mix and print with multiple different intermediate gloss coating inks at a time by including a dedicated printhead or printhead array for each desired intermediate gloss level. For example, the coating system may include a first intermediate gloss coating module for mixing and printing a low to intermediate gloss ink and a second intermediate gloss coating module for mixing and printing an intermediate to high gloss ink. Any suitable number of different gloss levels may be achieved using the coating system. As the number of different gloss levels that are available increases, the gradation of the gloss on the printed media may be more continuous.

The coating modules 102, 102' may be removable for storage outside the imaging device, and/or to enable swapping of coating modules. By configuring the coating modules 102, 102' as removable or replaceable, the range of gloss levels that are capable of being applied by the imaging device may be increased without increasing the size or complexity of the imaging device.

To facilitate removal and/or replacement of the coating modules, the housing 170 of the coating modules may be configured for releasable connection to the print station of the imaging device in any suitable manner. For example, the print station may include module positions or slots that are configured to releasably secure a custom color module in an operable position adjacent the media pathway in the print station. The housings for separate coating modules are similarly sized so that the modules may be swapped or replaced as needed. The dispensers that control the flow of ink into the mixing reservoir of a custom color module may be configured as disconnect valves so that the supply lines may be removed from the modules prior to removal. The disconnect valves are advantageously configured to prevent the custom color ink from leading from the mixing reservoir when the custom color module is removed from the imaging device.

Accordingly, the imaging device 10 may be reconfigured at any time to suit the particular print jobs to be handled. For example, a user may have a particular print job which requires a coating having a specific gloss level not provided by any of the coating modules currently in the system. The user may switch one of the existing coating module for a coating module having the desired gloss level capabilities. This may be achieved without stopping printing operations by scheduling the changeover for a period of time when the remaining coating modules can handle the requirements of the jobs being printed at the time.

When a coating module is removed from the imaging device, the module may be placed in a cleaning unit (not shown) which may be configured to purge the ink from the module. A printer user may put a new, clean coating module into the imaging device and program it for a particular gloss level while the previous module is being cleaned and purged. The cleaning unit configuration may have any suitable configuration and may contain solvents for pumping through the printhead. Once cleaned, a coating module may be used to apply the same gloss level coating or a different gloss level coating.

The coating system has been described with reference to a phase change inkjet printer; however, the coating system may also be used in other types of inkjet printers where one desires to be able to mix and print multiple gloss level coatings from a preloaded set of gloss inks. Accordingly, those skilled in the art will recognize that numerous modifications can be made to the specific implementations described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A coating system for use in an inkjet imaging device, the coating system comprising:

a high gloss coating ink supply source for supplying a high gloss coating ink having a first gloss level;

a low gloss coating ink supply source for supplying a low gloss coating ink having a second gloss level, the second gloss level being less than the first gloss level;

a coating module configured to receive the high gloss coating ink and the low gloss coating ink from the high gloss coating ink supply source and the low gloss coating ink supply source, respectively, the coating module including:

a first group of inkjet nozzles configured to eject the high gloss coating ink;

a second group of inkjet nozzles configured to eject the low gloss coating ink;

a reservoir having an ink stirrer positioned within the reservoir, the reservoir configured to receive quantities of the high gloss coating ink and the low gloss coating ink and the ink stirrer configured to commingle a quantity of the high gloss coating ink and a quantity of the low gloss coating ink to generate an intermediate gloss coating ink, the intermediate gloss coating ink having a gloss level between the first gloss level and the second gloss level;

a third group of inkjet nozzles operatively connected to the reservoir to receive the intermediate gloss coating ink from the reservoir and to eject the intermediate gloss coating ink; and a controller operatively connected to the ink stirrer, the controller being configured to operate the stirrer with reference to mixing data.

2. The coating system of claim 1, the reservoir further comprising:

a first opening, a second opening and a third opening, the first opening being configured for removable connection to the high gloss coating ink supply source, the second opening being configured for removable connection to the low gloss coating ink supply source, the third opening being operatively connected to the third group of inkjet nozzles;

a first dispenser operatively connected to the first opening, the first dispenser being configured to open and close the first opening to enable and disable a flow of the high gloss coating ink into the reservoir;

a second dispenser operatively connected to the second opening, the second dispenser being configured to open and close the second opening to enable and disable a flow of the low gloss coating ink into the reservoir; and an inkjet dispenser operatively connected between the third opening and the third group of inkjet nozzles, the inkjet dispenser being configured to open and close the third opening to enable and disable a flow of the intermediate gloss coating ink from the reservoir to the third group of inkjet nozzles.

3. The coating system of claim 2, further comprising:

a memory in which a plurality of gloss level identifiers are stored, the memory including gloss ink mixing data stored in association with each gloss level identifier; and the controller is electrically coupled to the memory and to the first and second dispenser, the controller being configured to open and close the first and second dispensers to enable and disable flow of the high gloss coating ink and the low gloss coating ink into the reservoir in accordance with the gloss ink mixing data stored in association with one of the gloss level identifiers stored in the memory.

4. The coating system of claim 3, the controller being configured to receive a gloss level identifier as an input, the gloss level identifier corresponding to the gloss level of the intermediate gloss coating ink, the controller being configured to access the memory to retrieve the gloss ink mixing data corresponding to the intermediate gloss coating ink using the gloss level identifier.

5. The coating system of claim 1, the first, second and third group of inkjet nozzles each being incorporated into a printhead.

6. The coating system of claim 1, the first, second and third group of inkjet nozzles each comprising a separate printhead.

7. The coating system of claim 1, the reservoir and the third group of inkjet nozzles being supported by a housing, the housing being configured for installation and removal from an inkjet imaging device.

8. The coating system of claim 1, the high gloss coating ink and the low gloss coating ink each comprising a radiation curable ink.

9. The coating system of claim 1, the high gloss coating ink and the low gloss coating ink each comprising an aqueous ink.

10. An inkjet imaging device comprising:

an image receiving surface;

a plurality of colored ink supply sources, each colored ink supply source being configured to supply a different color of ink;

a printhead operatively connected to at least one colored ink supply sources, the printhead being positioned to emit the colored ink received from the at least one colored ink supply source onto the image receiving surface;

a high gloss coating ink supply source for supplying a high gloss coating ink having a first gloss level, and a low gloss coating ink supply source for supplying a low gloss coating ink having a second gloss level, the second gloss level being less than the first gloss level;

a coating module configured to receive the high gloss coating ink and the low gloss coating ink from the a high gloss coating ink supply source and the low gloss coating ink supply source, respectively, the coating module including:

a first group of inkjet nozzles configured to eject the high gloss coating ink onto the image receiving surface;

a second group of inkjet nozzles configured to eject the low gloss coating ink onto the image receiving surface;

a reservoir having an ink stirrer positioned within the reservoir, the reservoir configured to receive quantities of the high gloss coating ink and the low gloss ink and the ink stirrer configured to commingle a quantity of the high gloss coating ink and a quantity of the low gloss coating ink to generate an intermediate gloss coating ink, the intermediate gloss coating ink having a gloss level between the first gloss level and the second gloss level;

a third group of inkjet nozzles operatively connected to the reservoir to receive the intermediate gloss coating ink from the reservoir and to eject the intermediate gloss coating ink onto the image receiving surface; and a controller operatively connected to the ink stirrer, the controller being configured to operate the stirrer with reference to mixing data.

11. The inkjet imaging device of claim 10, the reservoir further comprising:

a first opening, a second opening and a third opening, the first opening being configured for removable connection to the high gloss coating ink supply source, the second opening being configured for removable connection to the low gloss coating ink supply source, the third opening being operatively connected to the third group of inkjet nozzles;

a first dispenser operatively connected to the first opening, the first dispenser being configured to open and close the first opening to enable and disable a flow of the high gloss coating ink into the reservoir;

a second dispenser operatively connected to the second opening, the second dispenser being configured to open and close the second opening to enable and disable a flow of the low gloss coating ink into the reservoir; and an inkjet dispenser operatively connected between the third opening and the third group of inkjet nozzles, the inkjet dispenser being configured to open and close the third opening to enable and disable a flow of the intermediate gloss coating ink from the reservoir to the third group of inkjet nozzles.

12. The inkjet imaging device of claim 11, further comprising:

a memory in which a plurality of gloss level identifiers are stored, the memory including gloss ink mixing data stored in association with each gloss level identifier; and the controller is electrically coupled to the memory and to the first and second dispensers, the controller being configured to open and close the first and second dispensers to enable and disable flow of the high gloss coating ink and the low gloss coating ink into the reservoir in accordance with the gloss ink mixing data stored in association with one of the gloss level identifiers stored in the memory.

13. The inkjet imaging device of claim 12, the controller being configured to receive a gloss level identifier as an input, the gloss level identifier corresponding to the gloss level of the intermediate gloss coating ink, the controller being configured to access the memory to retrieve the gloss ink mixing data corresponding to the intermediate gloss coating ink using the gloss level identifier.

14. The inkjet imaging device of claim 10, the first, second and third group of inkjet nozzles each being incorporated into a printhead.

15. The inkjet imaging device of claim 10, the first, second and third group of inkjet nozzles each comprising a separate printhead.

16. The inkjet imaging device of claim 10, the reservoir and the third group of inkjet nozzles being supported by a housing, the housing being configured for installation and removal from the inkjet imaging device.

17. The inkjet imaging device of claim 10, the high gloss coating ink and the low gloss coating ink each comprising a radiation curable ink.

18. The inkjet imaging device of claim 10, further comprising:

a second coating module configured to receive the high gloss coating ink and the low gloss coating ink from the a high gloss coating ink supply source and the low gloss coating ink supply source, respectively, the second coating module including:

a reservoir having an ink stirrer positioned within the reservoir, the reservoir configured to receive quantities of the high gloss coating ink and the low gloss ink and the ink stirrer configured to commingle a second quantity of the high gloss coating ink and a second quantity of the low gloss coating ink to generate a second intermediate gloss coating ink, the second intermediate gloss coating ink having a gloss level between the first gloss level and the second gloss level and different than the gloss level of the intermediate gloss coating ink;

a third group of inkjet nozzles operably operatively connected to the reservoir to receive the second intermediate gloss coating ink from the reservoir and to eject the second intermediate gloss coating ink onto the image receiving surface; and the controller being operatively connected to the ink stirrer in the reservoir of the second coating module.

19. A method of operating a coating system of an inkjet imaging device, the method comprising:

supplying a high gloss coating ink having a first gloss level to a first group of inkjet nozzles and to a first reservoir;

supplying a low gloss coating ink having a second gloss level to a second group of inkjet nozzles and to the first reservoir, the second gloss level being less than the first gloss level;

stirring the high gloss coating ink and the low gloss coating ink in the first reservoir to generate an intermediate gloss coating ink, the intermediate gloss coating ink having a gloss level between the first gloss level and the second gloss level and the stirring being controlled with reference to mixing data;

supplying the intermediate gloss coating ink to a third group of inkjet nozzles; and selectively ejecting at least one of the high gloss coating ink, the low gloss coating ink, and the intermediate gloss coating ink from the first, second and third groups of inkjet nozzles, respectively.

20. The method of claim 19, further comprising:

supplying the high gloss coating ink having a first gloss level to a second reservoir;

supplying the low gloss coating ink having a second gloss level to the second group of inkjet nozzles and to the second reservoir;

stirring the high gloss coating ink and the low gloss coating ink in the second reservoir to generate a second intermediate gloss coating ink, the second intermediate gloss coating ink having a gloss level between the first gloss level and the second gloss level and different from the intermediate gloss level and the stirring being controlled with reference to mixing data; and supplying the second intermediate gloss coating ink to a fourth group of inkjet nozzles.

21. The method of claim 20, further comprising:

selectively ejecting at least one of the high gloss coating ink, the low gloss coating ink, the intermediate gloss coating ink and the second intermediate gloss coating ink to form a gloss coating on an image receiving surface.

* * * * *